US005863145A

United States Patent [19]

Dumler et al.

[11] Patent Number: 5,863,145

[45] Date of Patent: Jan. 26, 1999

[54] CONTAINER WITH A SCREWED CAP FOR NAIL VARNISH, LIQUID MASCARA OR THE LIKE

[75] Inventors: Norbert Dumler, Ansbach; Günter Bachmann, Neuendettelsau, both of Germany

[73] Assignee: Georg Karl Geka-Brush GmbH, Bechhofen-Waizendorf, Germany

[21] Appl. No.: 737,275

[22] PCT Filed: Mar. 9, 1995

[86] PCT No.: PCT/EP95/00873

§ 371 Date: Jan. 9, 1997

§ 102(e) Date: Jan. 9, 1997

[87] PCT Pub. No.: WO95/30591

PCT Pub. Date: Nov. 16, 1995

[30] Foreign Application Priority Data

May 10, 1994 [DE] Germany ..... 44 16 448.3

[51] Int. Cl.[6] ..... A46B 11/00; B65D 41/04

[52] U.S. Cl. ..... 401/129; 401/126; 215/331

[58] Field of Search ..... 401/126, 129; 215/331, 223, 204

[56] References Cited

U.S. PATENT DOCUMENTS

| | | | |
|---|---|---|---|
| 4,271,974 | 6/1981 | Quinard | 215/331 |
| 4,273,248 | 6/1981 | Lehmann | 215/331 |

FOREIGN PATENT DOCUMENTS

| | | | |
|---|---|---|---|
| 0 375 495 | 6/1990 | European Pat. Off. . | |
| 0 514 659 | 11/1992 | European Pat. Off. . | |
| 2413284 | 8/1979 | France | 215/331 |
| 2 439 137 | 5/1980 | France . | |
| 30 07 985 | 9/1981 | Germany . | |
| 3118833 | 12/1982 | Germany | 215/204 |
| 88 02 581 | 5/1988 | Germany . | |
| 2046228 | 11/1980 | United Kingdom | 215/331 |
| 2146314 | 4/1985 | United Kingdom . | |
| 90/12521 | 11/1990 | WIPO . | |

*Primary Examiner*—Steven A. Bratlie
*Attorney, Agent, or Firm*—Browdy and Neimark

[57] ABSTRACT

The invention is directed to a container with a screwed cap for nail varnish and liquid mascara having a closed position of the screwed cap in relation to the container defined by at least one end stop and a cover rotatably fitted on the screwed cap. The container and screwed cap further have a peripheral annular shoulder (22) with a thread-like pitch formed on the outer surface of the screwed cap at an angle to the longitudinal axis of the screwed cap to produce a stop shoulder (27) on a transition region between a beginning (25) and an end (26) of the annular shoulder (22). A guide slot extends downwards from the stop shoulder (27) and aligns therewith. A guide rib having a width corresponding to a width of the guide slot (28) formed on the inner wall of the cover (7) and runs parallel to longitudinal axes (16, 17) of the screwed cap and the cover for engagement in the guide slot.

15 Claims, 1 Drawing Sheet

CONTAINER WITH A SCREWED CAP FOR NAIL VARNISH, LIQUID MASCARA OR THE LIKE

GENERAL DESCRIPTION OF THE INVENTION

1. Field of the Invention

The invention pertains to a container with a screwed cap for nail varnish, liquid mascara or the like, in which the closed position of the screwed cap in relation to the container is defined by at least one end stop and in which a cover is fitted on the screwed cap to be integral in rotation therewith.

2. Prior Art

Containers of this type frequently have an exterior decoration in the form of an imprint to present a decorative and sales promoting appearance, whereby this decoration—be it in the form of a graphic design or lettering—frequently extends from the outer surface of the cover onto the container itself.

It is considered a major defect in the packaging, especially of high-quality products, if an inaccurate positioning of the screwed cap or cover in relation to the container results in a misalignment, either during the initial machine-fitting or during later use, resulting in an adverse effect on the appearance of the overall decoration.

The thread between the screwed cap and the container neck has therefore been designed with stops of a highly intricate geometry to produce an audible and tactile engaging effect and ensure a reliable alignment in the end position.

However, until now the occurrence of tolerances or misalignments between the cover and the screwed cap during the initial fitting could not always be effectively prevented, thus rendering ineffectual the precision initially gained with the stops.

OBJECT AND SUMMARY OF THE INVENTION

The aim of the invention is therefore to further develop a container of the above type so that the cover can be machine-fitted onto the screwed cap in a fully automatic process while ensuring an optimum alignment.

This aim is attained according to the invention with a peripheral annular shoulder having a thread-like pitch formed on the outer surface or the inside of the cover to produce a stop shoulder on the transition region between the beginning and the end of said annular shoulder, and with a guide slot extending downwards from the stop shoulder and aligned therewith, and with a guide rib, the width of which corresponds to the width of the guide slot, formed on the inside of the cover or the outer surface of the screwed cap and extending parallel to the longitudinal axis.

When the cover is placed onto the screwed cap and rotated at any angle in relation to the screwed cap during machine-fitting, the underside of the guide rib glides along the annular shoulder until it reaches the stop shoulder, so that the guide rib can engage into the guide slot and the cover can be completely pushed down onto the screwed cap in a defined angle in relation to the screwed cap.

The annular shoulder is advantageously designed to curve around slightly less than 360°. However, this is not an essential requirement for the implementation of the invention. In one design of the invention the annular shoulder has a constant pitch, but other designs are also perceivable in which the annular shoulder curves along a longer section of its peripheral angle with no pitch in relation to a plane perpendicular to the longitudinal axis, and only forms a pitch or slope along a short angular section in front of the guide slot.

In a preferred design of the invention, the annular shoulder has a pitch of approximately 2 mm per 360°.

The outer surface or the inside, respectively, of the screwed cap or the cover respectively, are advantageously furthermore designed with a plurality of slots running parallel to each other and to the longitudinal axis and with corresponding ribs formed on the inside of the cover or on the outer surface of the screwed cap, respectively. These additional ribs create a defined interconnection with which the proper alignment of the cover with the screwed cap will be effectively maintained during later use.

For the sake of simplicity, the following is based on the assumption that the slots are formed on the outer surface of the screwed cap whereby, as explained above, the same effect can be attained if the slots are instead formed on the cover.

A cover with a virtually square profile may accordingly be designed with at least one rib in the area of each center of the cover and a guide rib in the area of one corner of the cover.

If the container is designed as a container for nail varnish, for example, and the screwed cap is accordingly designed with an applicator element with a stem and a brush holder that extends downwards over the container opening, the design may advantageously provide for the annular flange of the brush holder extending downwards over the container opening to rest flatly on the surface of the container opening to ensure a reliable and tight connection preventing the spillage of liquid and evaporation of volatile components.

This effect is attained largely due to the brush holder being locked in place inside the screwed cap by means of an annular bead and an annular groove, whereby the annular groove extends farther in an axial direction than the annular bead. During pre-assembly of the brush holder inside the screwed cap, the brush holder is positioned so that the annular bead comes to rest inside the annular groove as close to the bottom of the annular groove as possible. This results in the annular bead being pushed upwards during the fitting process to the extent required by the specific geometry of the glass container or its specific deviation from the nominal dimensions. In the lowest position of the annular bead a close-fitting connection is always attained even if the dimensions of the glass container are within the lower range of the permissible tolerance. On the other hand, if the glass container is oversized within the customary wide range of tolerances, a close-fitting, tight connection is attained on the one hand and a deformation of the plastic through squeezing and resulting creeping at normal temperature is prevented on the other hand. The design according to the invention thus results in a reliable transfer of the torque of the rotation in circumferential and axial direction from the cover to the screwed cap and thus onto the relevant sealing surfaces.

A sealing cone may furthermore extend into the container opening from the underside of the brush holder in a known fashion.

To attain an optimum transmission of force onto the sealing surfaces, the inside of the lid of the screwed cap advantageously has an annular projection and the inside of the brush holder a hollow section along the surface of which ribs extend parallel to the longitudinal axis so that the annular projection presses onto the topside of the ribs when the brush holder is inserted.

BRIEF DESCRIPTION OF THE DRAWINGS

The invention is described in detail below, based on a preferred design, in connection with the drawing. The figures show the following.

DETAILED DESCRIPTION OF THE PREFERRED EMBODIMENT (S) OF THE INVENTION

Figure 1:
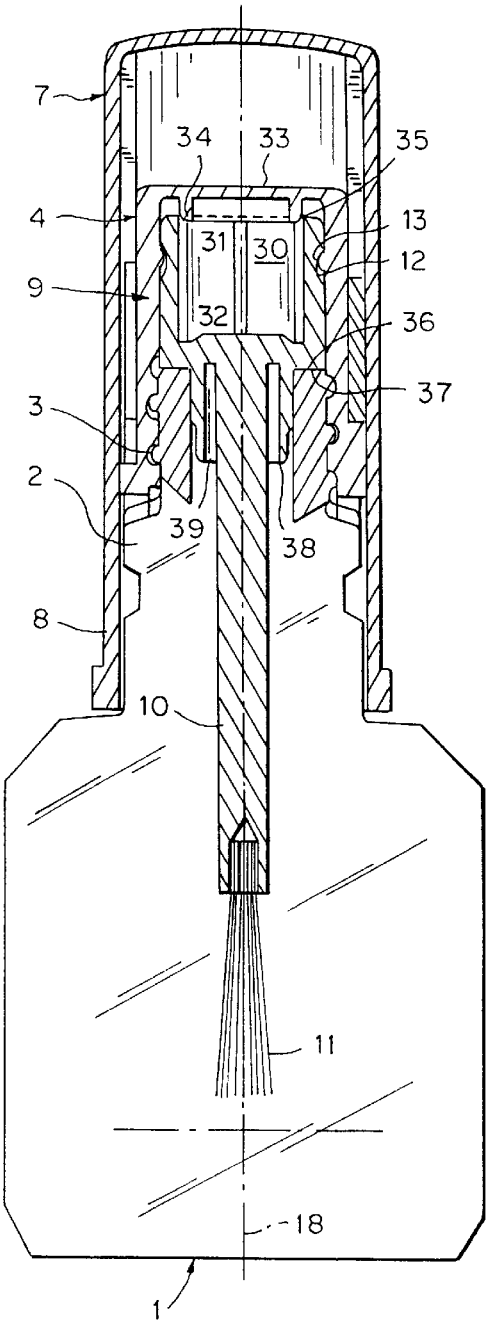
FIG. 1 a section through a container according to the invention in its closed condition, FIG. 2 a longitudinal section through the cover, FIG. 3 a plan view on the cover as seen from underneath, and FIG. 4 a side view of the screwed cap.

A container shown in the drawing is designed as a glass container 1 for nail varnish, for example, and comprises a neck 2 with an exterior thread 3, onto which a screwed cap 4 can be fitted so that the stops 6 formed on the container neck 2 or on the underside 5 of the screwed cap 4 produce a defined end position during fitting of the cap. Fitted over the screwed cap 4 is a cover 7, the lower section 8 of which extends downwards around the neck 2 of the container and also upwards beyond the screwed cap 4 to create both, a comfortable grip for handling as well as an appealing appearance.

Inside the screwed cap 4, the brush holder 9 for an applicator comprising a stem 10 and brush 11 is locked into place by an annular bead 12 on the inside of the screwed cap 4 and a corresponding annular groove 13 on the outer surface of the brush holder 9, with the annular groove 13 extending farther in an axial direction than the annular bead 12 so that the annular bead 12 can move into a position corresponding to the dimension tolerances of the glass container that produces a close-fitting, tight connection to the container opening as described below.

Figure 2:
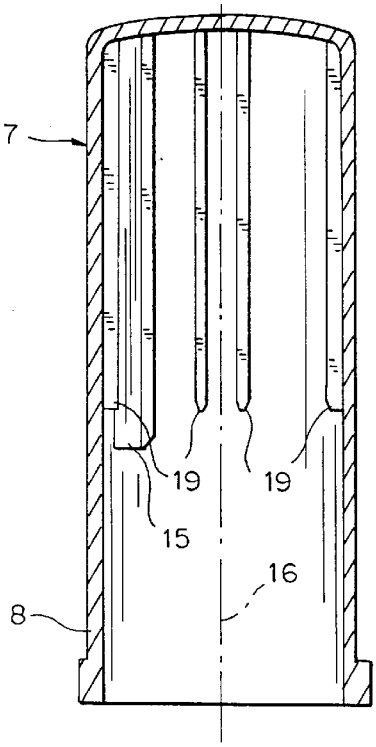
Figure 3:
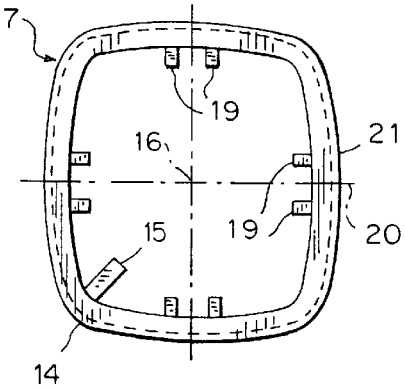
Figure 4:
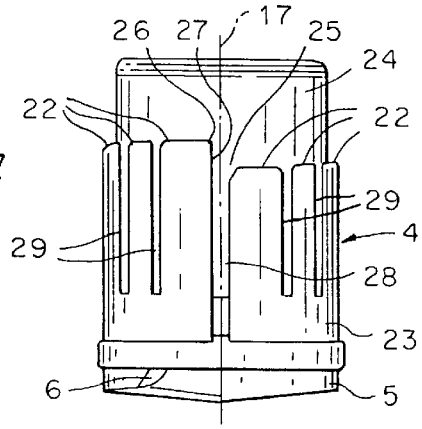

As can be seen particularly from FIG. 2 and 3, the cover 7 of the example design has a roughly square profile with rounded sides. In the area of a corner 14 of the cover 7, a guide rib 15 extends inward in direction of the median line, running parallel to the longitudinal axis 16 of the cover 7, or parallel to the longitudinal axis 17 of the screwed cap 4, or parallel to the longitudinal axis 18 of the container 1.

Ribs 19 which also run parallel to the longitudinal axis 16 are formed on both sides of the center 20 of each side wall 21 of the cover 7. As shown in FIG. 2, the length of the guide rib 15 in longitudinal direction is slightly greater than that of the ribs 19 which are all of equal length.

The screwed cap 4 has an annular shoulder 22 on its outer surface, representing the transition region between a lower section 23 and an upper section 24 of the screwed cap 4, with the lower section 23 having a larger diameter than the upper section 24.

The annular shoulder 22 has a thread-like pitch, so that a stop shoulder 27 is formed between the beginning 25 of the annular shoulder 22 and its end 26, with a guide slot 28 extending downward from the stop shoulder 27 and flush with the same. On the outer surface of section 23 of the screwed cap 4 additional slots 29 extend downwards from the annular shoulder 22, matching the circumferential distribution of the ribs 19 on the inside of the cover 7. The width of the guide slot 28 corresponds to the width of the guide rib 15 and the width of the slots 29 corresponds to the width of the guide ribs 19 whereby the width of the guide slot 28 and the corresponding guide rib 15 is larger than the width of the slots 29 so that the guide rib 15 cannot enter into the slots 29.

This permits a fully automatic machine-fitting of the cover 7 onto the screwed cap 4 by which the cover 7 can be placed onto the screwed cap 4 in any random position and rotated starting from an accordingly random angle until the guide rib 15 comes to rest on the stop shoulder 27 and accordingly engages into the guide slot 28, along which the cover 7 can now be pushed down onto the screwed cap 4 until it reaches the limit stop. At the same time the ribs 19 enter into the slots 29 so that an absolutely defined interconnection is produced between the cover 7 and the screwed cap 4, both in circumferential as well as in axial direction, while compensating for any potential manufacturing tolerances so that the same positioning accuracy in circumferential direction is attained for the cover 7 as for the screwed cap 4 based on the stops 6 which are described in more detail, for example, in connection with the German patent application P 44 02 227.

The brush holder 9 has an interior hollow section 30 with an interior wall 31, along which ribs 32 extend parallel to the longitudinal axis 17 of the screwed cap 4. From the lid 33 of the screwed cap 4 an annular projection 34 extends which is positioned in a radial direction so that it rests on the topside 35 of the ribs 32 in the assembled condition shown in FIG. 1.

An annular flange 36 is formed on the underside of the brush holder 9 so that the annular flange 36 rests flat against the face 37 of the container neck 2 and its close-fitting connection is effectively attained by the transmission of force from the cover 7 to the screwed cap 4 and onward from its lid 33 to the annular projection 34 onto the ribs 32. A sealing cone 38 elastically extends into the opening of the container neck 2, the effect of which is further supported in a known manner by an annular groove 39.

The ribs 32 preferably consist of a relatively soft plastic material, such as LTPE, and the annular gap of a relatively hard plastic material, such as PP.

We claim:

1. Container with a screwed cap for nail varnish and liquid mascara having a closed position of the screwed cap in relation to the container defined by at least one end stop and a cover rotatably fitted on the screwed cap, said container and screwed cap further comprising a peripheral annular shoulder (22) with a thread pitch formed on the outer surface of the screwed cap at an angle to a longitudinal axis (17) thereof, to produce a stop shoulder (27) on a transition region between a beginning (25) and an end (26) of the annular shoulder (22), a guide slot (28) extending downwards from the stop shoulder (27) and aligned therewith, and a guide rib (15) having a width corresponding to a width of the guide slot (28) formed on the inner wall of the cover (7), the guide slot (28) and the guide rib (15) running parallel to the longitudinal axis (17) of the screwed cap.

2. Container according to claim 1, wherein the annular shoulder (22) has a pitch of approximately 2 mm per 360°.

3. Container according to claim 1, wherein a plurality of slots (29) running parallel to each other and to the longitudinal axis (17) of the screwed cap are formed on the outer surface of the screwed cap (4), and that corresponding ribs (19) are formed on the inside of the cover (7).

4. Container according to claim 1 with a cover having a nearly square profile, wherein at least one rib (19) is formed in the area of each center (20) of the cover (7) and that the guide rib (15) is formed in the area of one corner (14) of the cover (7).

5. Container according to claim 1, having an applicator comprising a stem and a brush holder inserted into the screwed cap, whereby the brush holder extends downward over an opening for the container wherein an annular flange (36) of the brush holder (9) extending downwards over a neck of the container rests flat against a face (37) of the opening for container.

6. Container according to claim 5, wherein the brush holder (9) is fastened inside the screwed cap (4) by means of an annular bead (12) and an annular groove (13), whereby the annular groove (13) extends further along an axial direction than the annular bead (12).

7. Container according to claim 5, wherein an annular projection (34) is formed on an inside of a lid (33) of the screwed cap (4) and that the inside of the brush holder (9) has a hollow section, along the surface of which ribs (31) extend parallel to the longitudinal axis of the cover in a manner so that the annular projection (34) pushes down on a topside (35) of the ribs (31) when the brush holder (9) is inserted.

8. Container according to claim 5, wherein a sealing cone (38) extends from the underside of the brush holder (9) into the container opening.

9. Container with a screwed cap for nail varnish and liquid mascara having a closed position of the screwed cap in relation to the container defined by at least one end stop and a cover rotatably fitted on the screwed cap, said container and screwed cap further comprising a peripheral annular shoulder (22) with a thread pitch formed on the inside side cover (7) at an angle to a longitudinal axis (16) thereof, to produce a stop shoulder (27) on a transition region between a beginning (25) and an end (26) of the annular shoulder (22), with a guide slot (28) extending downward from the stop shoulder (27) and aligned therewith, and a guide rib (15) having a width corresponding to a width of the guide slot (28) formed on the outer surface of the screwed cap, the guide rib (15) and guide slot (28) running parallel to the longitudinal axis (16) of the cover.

10. Container according to claim 9, wherein the annular shoulder (22) has a pitch of approximately 2 mm per 360°.

11. Container according to claim 9, wherein a plurality of slots (29) running parallel to each other and to a longitudinal axis (16) of the cover (7) are formed on the inner surface of the cover (7) and that corresponding ribs (19) are formed on the outer surface of the screwed cap (4).

12. Container according to claim 9, having an applicator comprised of a stem and a brush holder inserted into the screwed cap, whereby the brush holder extends downwards over an opening for the container, wherein an annular flange (36) of the brush holder (9) extending downwards over a neck of the container rests flat against a face (37) of the opening for container.

13. Container according to claim 12, wherein the brush holder (9) is fastened inside the screwed cap (4) by means of an annular bead (12) and an annular groove (13), whereby the annular groove (13) extends further along an axial direction than the annular bead (12).

14. Container according to claim 12, wherein an annular projection (34) is formed on an inside of a lid (33) of the screwed cap (4) and that the inside of the brush holder (9) has a hollow section, along the surface of which ribs (31) extend parallel to the longitudinal axis of the cover in an manner so that the annular projection (34) pushes down on a topside (35) of the ribs (31) when the brush holder (9) is inserted.

15. Container according to claim 12, wherein a sealing cone (38) extends from the underside of the brush holder (9) into the container opening.

* * * * *